US007325345B2

(12) United States Patent
Hailo

(10) Patent No.: US 7,325,345 B2
(45) Date of Patent: Feb. 5, 2008

(54) SIGN

(75) Inventor: Gwendoline Doris Hailo, Surfers Paradise (AU)

(73) Assignee: Safe Signs Australia Pty Ltd, Queensland (AU)

( * ) Notice: Subject to any disclaimer, the term of this patent is extended or adjusted under 35 U.S.C. 154(b) by 0 days.

(21) Appl. No.: 10/416,834

(22) PCT Filed: Nov. 15, 2001

(86) PCT No.: PCT/AU01/01483

§ 371 (c)(1),
(2), (4) Date: Oct. 16, 2003

(87) PCT Pub. No.: WO02/41286

PCT Pub. Date: May 23, 2002

(65) Prior Publication Data

US 2004/0055195 A1 Mar. 25, 2004

(30) Foreign Application Priority Data

Nov. 15, 2000 (AU) ..... PR1510
Mar. 2, 2001 (AU) ..... PR3490

(51) Int. Cl.
*G09F 15/00* (2006.01)

(52) U.S. Cl. ..... 40/610; 40/598; 40/611.01; 40/611.09; 40/611.1; 40/618; 116/63 P

(58) Field of Classification Search ..... 40/610, 40/598, 611.01, 611.06, 611.09, 611.1, 612, 40/618
See application file for complete search history.

(56) References Cited

U.S. PATENT DOCUMENTS 1,893,567 A * 1/1933 Solomita ..... 40/618

(Continued)

FOREIGN PATENT DOCUMENTS

GB 2231997 A * 11/1990

(Continued)

*Primary Examiner*—Gary C. Hoge
(74) *Attorney, Agent, or Firm*—Young & Thompson

(57) ABSTRACT

A self supporting resilient sign is assembled as a prism form a collapsed flat transport position and comprises pair of rectangular blanks of white, exterior grade pvc joined by a series of parallel, welded seams. The seams divide the blanks into a pair of panel pockets and a pair of weight pockets. The panel pockets each contain a squab made of plastic foam. The weight pockets house a strip of mdf This is sufficiently dense to prevent wind forces moving the signs. Strips of hook and pile fasteners line the obverse and reverse spaces of the plastic so that in the erected mode they overlap. Eyelets permit anchorage by a ground pin. The display faces lie at 70° to the horizontal and are directly printed with advertising material. The separation between these surfaces is about 100.

11 Claims, 2 Drawing Sheets

U.S. PATENT DOCUMENTS

| | | | | | |
|---|---|---|---|---|---|
| 2,186,913 | A | * | 1/1940 | Jonas | 40/446 |
| 2,292,785 | A | * | 8/1942 | Henne | 40/598 |
| 2,597,003 | A | * | 5/1952 | Johnson | 40/612 |
| 2,869,504 | A | * | 1/1959 | Andrews et al. | 116/63 P |
| 2,881,662 | A | * | 4/1959 | Harris | 248/472 |
| 3,322,093 | A | * | 5/1967 | Goland et al. | 116/63 R |
| 3,354,567 | A | * | 11/1967 | Philbin et al. | 40/598 |
| 3,458,944 | A | * | 8/1969 | Jimenez | 40/447 |
| 3,634,961 | A | * | 1/1972 | Nawalaniec | 40/598 |
| 4,977,697 | A | * | 12/1990 | Genick | 40/610 |
| 5,095,642 | A | * | 3/1992 | George et al. | 40/610 |
| 5,358,762 | A | * | 10/1994 | McGrath | 428/12 |
| 5,784,814 | A | * | 7/1998 | Capehart | 40/121 |
| 6,131,320 | A | * | 10/2000 | Eberle et al. | 40/610 |
| 6,651,367 | B1 | * | 11/2003 | Barragan | 40/610 |

FOREIGN PATENT DOCUMENTS

| | | |
|---|---|---|
| JP | 08-262985 | 10/1996 |
| WO | WO 99/59451 | 11/1999 |

* cited by examiner

SIGN

FIELD OF THE INVENTION

THIS INVENTION concerns signage and in particular but not limited to safe portable signage for use close to sporting fields where participants or spectators might accidentally collide with the signage. The present invention minimizes the risk of injury.

BACKGROUND OF THE INVENTION

Many venues frequented by the public, whether sporting or otherwise have restrictions concerning what types of signs are permissible. It is common for sponsors to find bans on structures in game-viewing areas and size requirements in hotel precincts. Signs on highways indicating road repairs are a continual hazard. As soon as the signs are made sufficiently light to be portable, they are subject to wind displacement. Sponsors tend to apply advertising displays on the perimeter barriers on soccer grounds but barriers which are close enough to be seen during the course of play or by TV coverage are correspondingly dangerous to players. The danger and expense of injury to players resulting from collisions with barriers is a constant problem for the sponsors. It is common for sponsors of junior sporting teams to have signage on shirts but it is often not seen as a commercially viable advertising to provide portable on-field signage at the junior level. It would be desirable to provide an option to provide safe on field signage that is reusable, robust and economic at all levels.

OUTLINE OF THE INVENTION

In one aspect there is provided a portable, free-standing sign panel intended to be placed on the ground at a suitable display location, there being an upright display surface wherein the upright display surface is the outer face of an upholstered block which is sufficiently resilient to recover its shape if compressed and there being means to maintain the panel in its selected display position.

Typically the block is a cube or may be one panel of a panel assembly.

In another form the sign panel comprises a single panel constrained to form a hollow assembly which may be a cylinder, prism or other shape. Typically the sign panel is one of two or more panels articulated to present front and rear inclined display surfaces so that the sign is prism-shaped.

In another form the sign panel is one of two or more panels articulated to present front and rear display surfaces so that the sign is box-shaped.

The means to maintain the panel in its selected display position typically comprises a flap or flaps which may co-operate with ground fasteners which secure the flaps to ground. Other means may be employed that do not include ground fasteners such as may be provided by weights or other fastener-less means to resist sign movement, counter-weights being typical. Counter-weighted pouches that may be filled locally using water or soil are typical. There may be provision for ground fasteners and counterweights used together.

Typically the panel is a foam squab inside a waterproof film, the panel being joined to other panels by stitched or welded seams.

The sign may further include means provided to vary the display.

The means provided to vary the display may involve interchangeable panels or pockets for receiving tiles. Interchangeable signage panels, may typically retained in place using hook and pile fasteners of the VELCRO® type. Alternatively, transparent pockets may be employed so that tiles may be inserted into the pockets to provide a changeable display.

In one preferred application the sign panel may be configured as a scoreboard including means provided to vary a score indication between competing teams. The means provided to vary a score indication between competing teams preferably comprises transparent pockets so that score tiles may be inserted into the pockets to provide a changeable display.

Preferably, the sign panel is part of a collapsible panel assembly comprising articulated resilient panels collapsible to a flat transport position.

BRIEF DESCRIPTION OF THE DRAWINGS

One embodiment of the invention is now described by way of example with reference to the accompanying drawings in which.

METHOD OF PERFORMANCE

Figure 1:
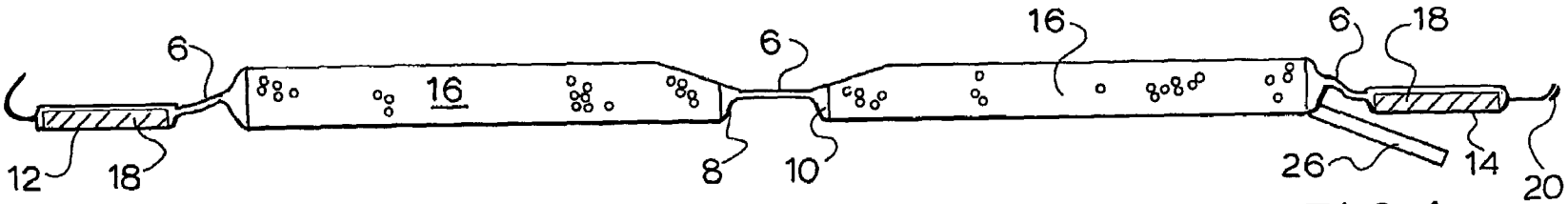
FIG. 1 is a section through the sign.
Figure 3:
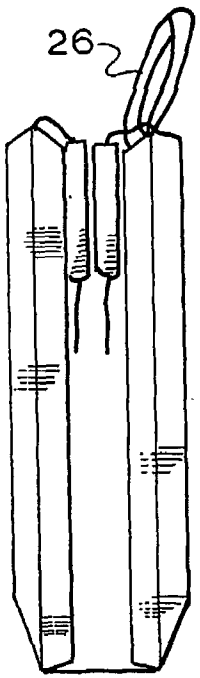
FIG. 3 is an end view of the sign in carrying mode.
Figure 2:
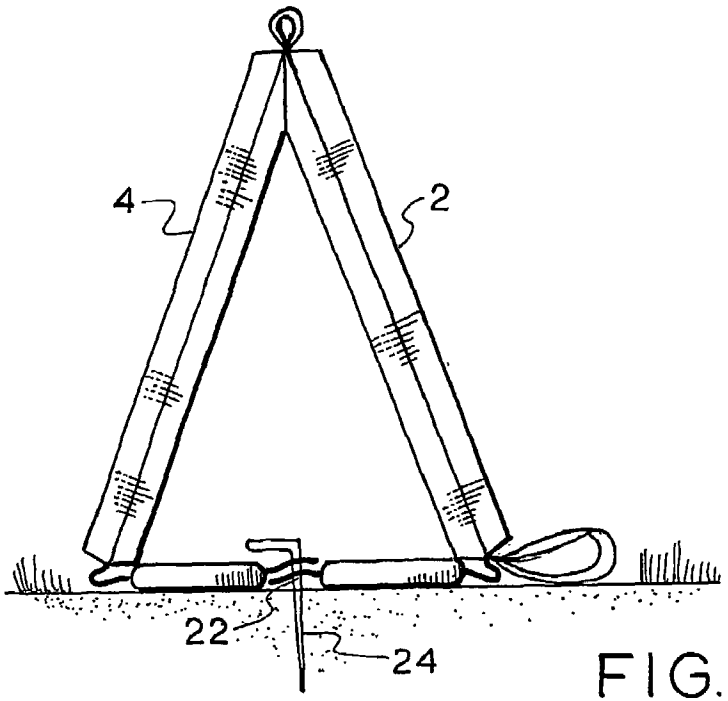
FIG. 2 is an end view of the erected sign.

A pair of rectangular blanks of white, exterior grade pvc 2,4 are joined by a series of parallel, welded seams 6. The seams divide the blanks into a pair of panel pockets 8,10 and a pair of weight pockets 12,14. The panel pockets each contain a squab 16 made of plastic foam. The weight pockets house a strip of mdf 18. This is sufficiently dense to prevent wind forces moving the signs. Strips of hook and pile fasteners 20 line the obverse and reverse spaces of the plastic so that in the erected mode they overlap. Eyelets 22 permit anchorage by a ground pin 24. The display faces 24 lie at 70° to the horizontal and are directly printed with advertising material. The separation between these surfaces is about 100 mm which enables the two panels to lie parallel while accommodating between them, the remaining parts.

The fabric carrying handle 26 allows the sign to be easily portable and taken in and out of a vehicle.

In use the sign is removed from the fabric pouch which protects the printed display surface and is erected by joining the hook and pile fasteners. The ground pins are sunk. This locates the sign at a pre-arranged distance from the edge of a sports field where it is readable by persons on both sides of the field. If play moves over the line and a player contacts the sign, it merely flattens under the player's weight and regains shape. Even if the player falls on the sign, no injury results.

Figure 4:
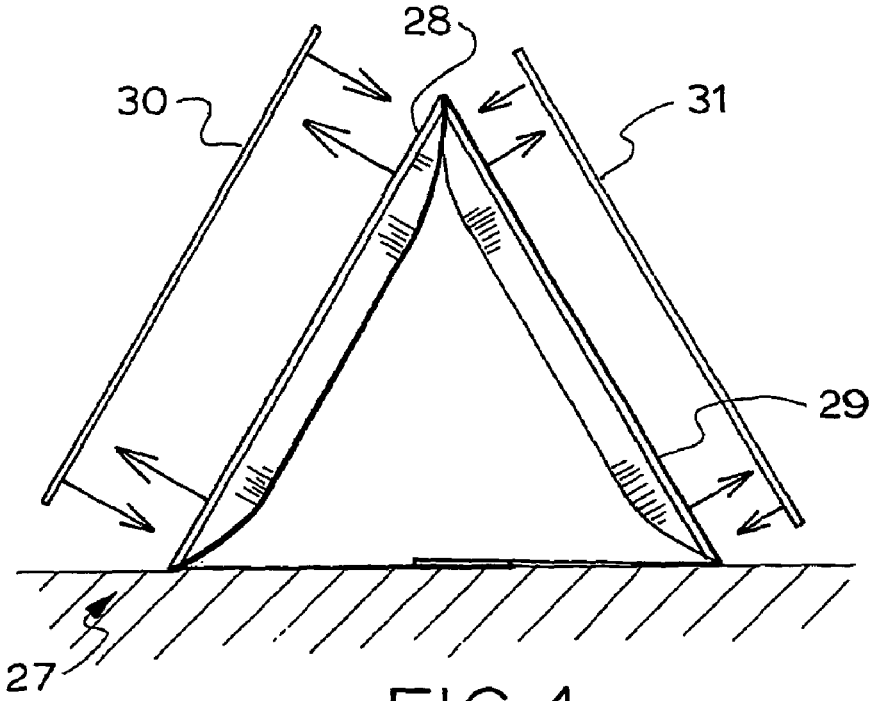
FIG. 4 is an end view of a sign with interchangeable signage panels.

FIG. 4 illustrates a sign 27 made in accordance with the foregoing description. In this case the signage panel shown at 28 and 29 may be removed and interchanged with a similar flexible panel 30, 31 so that the sign may be altered.

Figure 5:
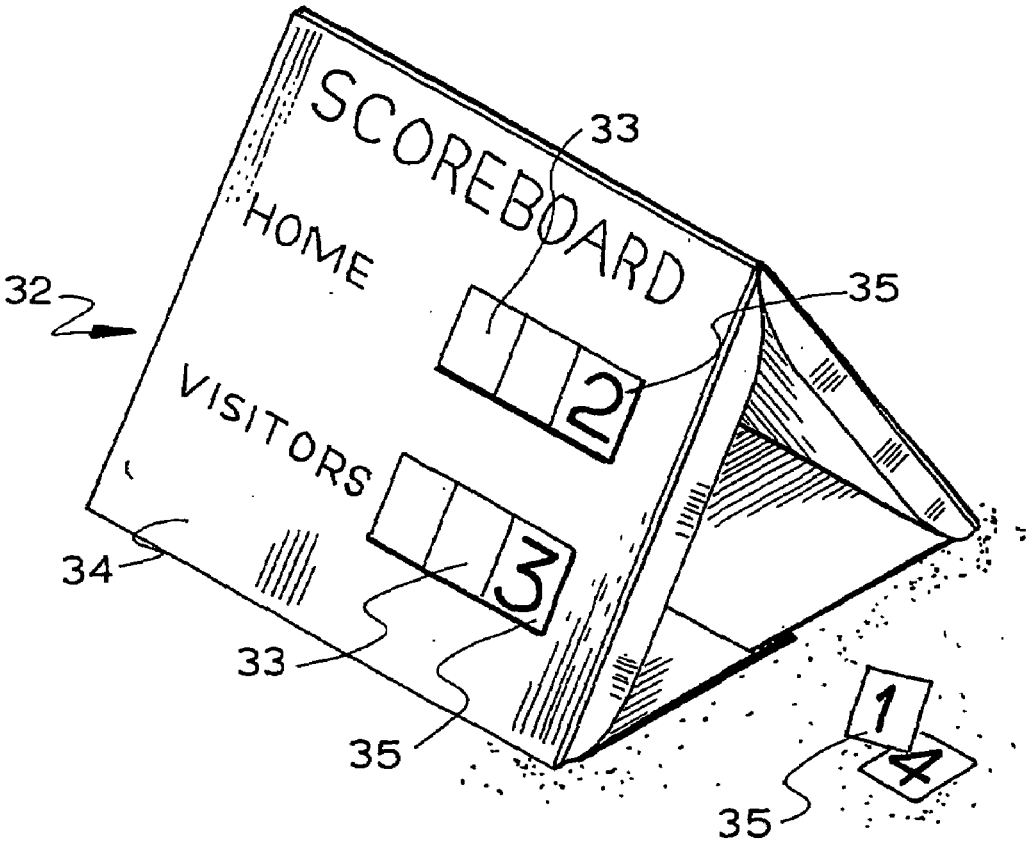
FIG. 5 is a perspective view of application of the invention to a scoreboard.

FIG. 5 is a further application to a scoreboard 32 where transparent plastics sheets 33 are welded to the panel 34 and number tiles 35 may be inserted into the pockets so formed to show the score.

Of course different arrangements of pockets and interchangeable panels (FIG. 4) may be employed for different applications.

We have found the advantages of the above embodiment to be:

1. Convenient occupation of prominent sites;
2. Safety for the public and players; and
3. Portability and ease of cleaning.

Whilst the above has been given by way of illustrative example of the present invention many variations and modifications thereto will be apparent to those skilled in the art without departing from the broad ambient and scope of the invention as set out in the appended claims.

The invention claimed is:

1. A portable, free-standing sign panel assembly of frameless construction intended to be placed on the ground at a suitable display location to form a frame-less self restoring compressible display, there being a first panel having an upright display surface wherein the upright display surface is the outer face of an upholstered block which is sufficiently resilient to recover its shape if compressed, a second panel joined to the first panel along a flexible joint so that the panels may fold together to a transport position, the second panel being sufficiently resilient to recover its shape if compressed and there being means to maintain the first and second panels in their selected display position, the means to maintain the first and the second panels in their selected display position comprising at least one connector flap having a weight containing pocket, the flap being joined to one of the said first or second panels along a flexible joint and having a free edge on a side of said flap opposite the last-named joint so that the flap may fold to a transport position between the folded together first and second panels or the flap may fold from its transport position and be operatively connected between the panels to maintain the first and the second panels in their selected display position, the said at least one flap and the said first and second panels being joined at their respective flexible joints by seams so the joints can not be separated, the seams being sufficiently wide to enable the sign panel assembly to fold to the transport position with the said at least one flap folded between the two panels with the panels in a generally parallel configuration while accommodating the said at least one flap between them, the sign panel assembly having a carrying handle extending from the assembly to enable the assembly to be easily carried when folded to the transport position.

2. A portable, free-standing sign panel according to claim 1 wherein the panels are articulated to present front and rear inclined display surfaces so that the sign is prism-shaped.

3. A portable, free-standing sign panel according to claim 1 wherein said at least one flap includes holes adapted to co-operate with ground fasteners which secure the flaps to the ground.

4. A portable, free-standing sign panel according to claim 1 wherein the display surface includes flexible transparent pockets for receiving interchangeable tiles, each tile having a recognizable alphanumeric symbol.

5. A portable, free-standing sign panel according to claim 1 configured as a scoreboard including means provided to vary a score indication between competing teams, the means provided to vary a score indication comprising two rows of transparent pockets and interchangeable tiles insert-able into the pockets, each tile having a recognizable alphanumeric symbol.

6. A portable, free-standing sign panel according to claim 1 wherein the sign panel is one of two or more panels articulated to present front and rear display surfaces so that the sign is box-shaped.

7. A portable, free-standing sign panel according to claim 1 configured as a scoreboard including means provided to vary a score indication between competing teams and wherein the panels present front and rear inclined display surfaces so that the sign is prism-shaped at least one display surface carries two rows of transparent pockets and there is provided interchangeable tiles insertable into the pockets, each tile having a recognizable alphanumeric symbol.

8. A portable, free-standing sign panel according to claim 1 configured as a scoreboard including means provided to vary a score indication between competing teams comprising transparent pockets and score tiles having a recognizable alphanumeric symbol so that the score tiles may be inserted into the pockets to provide a changeable display.

9. A portable, free-standing sign panel assembly of frameless construction intended to be placed on the ground at a suitable display location to form a frame-less self restoring compressible display, there being a first panel having an upright display surface wherein the upright display surface is the outer face of an upholstered block which is sufficiently resilient to recover its shape if compressed, a second panel joined to the first panel along a flexible joint so that the panels may fold together to a transport position, the second panel being sufficiently resilient to recover its shape if compressed and there being means to maintain the first and second panels in their selected display position, the means to maintain the first and the second panels in their selected display position comprising at least one connector flap having a weight containing pocket, the flap being joined to one of the said first or second panels along a flexible joint so that the flap may fold to a transport position between the folded together first and second panels or the flap may fold from its transport position and be operatively connected between the panels to maintain the first and the second panels in their selected display position, wherein the means to maintain the panel in its selected display position further comprises a second flap having a weight containing pocket, the second flap being joined to the other one of the said first or second panels along a flexible joint so that the second flap may fold to a transport position alongside the said at least one flap between the folded together first and second panels or the second flap may fold from its transport position and be operatively connected between the panels to maintain the first and the second panels in their selected display position.

10. A portable, free-standing sign panel assembly of frame-less construction intended to be placed on the ground at a suitable display location to form a frame-less self restoring compressible display, there being a first panel having an upright display surface wherein the upright display surface is the outer face of an upholstered block which is sufficiently resilient to recover its shape if compressed, a second panel joined to the first panel along a flexible joint so that the panels may fold together to a transport position, the second panel being sufficiently resilient to recover its shape if compressed and there being means to maintain the first and second panels in their selected display position, the means to maintain the first and the second panels in their selected display position comprising at least one connector flap having a weight containing pocket, the flap being joined to one of the said first or second panels along a flexible joint so that the flap may fold to a transport position between the folded together first and second panels or the flap may fold from its transport position and be operatively connected between the panels to maintain the first and the second panels in their selected display position, wherein the sign panel is one of two or more panels articulated to present front and rear inclined display surfaces so that the sign is prism-shaped, there being means provided to vary the display comprising interchangeable panels or pockets for receiving tiles, and the means to maintain the panel in its selected display position further comprises a second flap having a weight containing pocket, the second flap being joined to the other one of the said first or second panels along a flexible joint so that the second flap may fold to a transport position alongside the said at least one flap between the folded together first and second panels or the second flap may fold from its transport position and be operatively connected between the panels to maintain the first and the second panels in their selected display position.

11. A portable, free-standing sign panel assembly of frame-less construction intended to be placed on the ground at a suitable display location to form a frame-less self restoring compressible display, there being a first panel having an upright display surface wherein the upright display surface is the outer face of an upholstered block which is sufficiently resilient to recover its shape if compressed, a second panel joined to the first panel along a flexible joint so that the panels may fold together to a transport position, the second panel being sufficiently resilient to recover its shape if compressed and there being means to maintain the first and second panels in their selected display position, the means to maintain the first and the second panels in their selected display position comprising at least one connector flap having a weight containing pocket, the flap being joined to one of the said first or second panels along a flexible joint so that the flap may fold to a transport position between the folded together first and second panels or the flap may fold from its transport position and be operatively connected between the panels to maintain the first and the second panels in their selected display position, configured as a scoreboard including means provided to vary a score indication between competing teams, the sign panel being one of two or more panels articulated to present front and rear inclined display surfaces so that the sign is prism-shaped, the means provided to vary a score indication comprising alphanumeric tiles and transparent pockets for receiving the tiles, and the means to maintain the panel in its selected display position further comprises a second flap having a weight containing pocket, the second flap being joined to the other one of the said first or second panels along a flexible joint so that the second flap may fold to a transport position alongside the said at least one flap between the folded together first and second panels or the second flap may fold from its transport position and be operatively connected between the panels to maintain the first and the second panels in their selected display position.

* * * * *